US010772163B2

(12) United States Patent
Wilhelm Bavesteello et al.

(10) Patent No.: US 10,772,163 B2
(45) Date of Patent: Sep. 8, 2020

(54) APPARATUS FOR HEATING FLUIDS BY ROTARY MAGNETIC INDUCTION

(71) Applicant: EVUS, INC., Las Cruces, NM (US)

(72) Inventors: Edgar Wilhelm Bavesteello, Santiago (CL); Ximena Correa Torres, Puerto Varas (CL); Alexis Guarda Maximowitz, Puerto Montt (CL)

(73) Assignee: EVUS, INC., Las Cruces, NM (US)

( * ) Notice: Subject to any disclaimer, the term of this patent is extended or adjusted under 35 U.S.C. 154(b) by 265 days.

(21) Appl. No.: 15/735,375

(22) PCT Filed: Jul. 3, 2015

(86) PCT No.: PCT/CL2015/050023
§ 371 (c)(1),
(2) Date: Dec. 11, 2017

(87) PCT Pub. No.: WO2017/004729
PCT Pub. Date: Jan. 12, 2017

(65) Prior Publication Data

US 2018/0176999 A1 Jun. 21, 2018

(51) Int. Cl.
*H05B 6/10* (2006.01)

(52) U.S. Cl.
CPC ..... *H05B 6/108* (2013.01); *H05B 6/109* (2013.01)

(58) Field of Classification Search
CPC ..... H05B 6/108
USPC ..... 219/600–780
See application file for complete search history.

(56) References Cited

U.S. PATENT DOCUMENTS 4,308,225 A * 12/1981 Magarian ..... B29C 53/66 264/257
4,511,777 A 4/1985 Gerard
4,608,831 A * 9/1986 Gustafson ..... F17C 3/08 137/341
5,914,065 A * 6/1999 Alavi ..... H05B 6/108 219/631

(Continued)

FOREIGN PATENT DOCUMENTS

WO 02087285 A1 10/2002

OTHER PUBLICATIONS

International Search Report (English and Spanish) and PCT Written Opinion dated Feb. 9, 2016 issued in corresponding PCT International Application No. PCT/CL2015/050023.

*Primary Examiner* — Lori L Baker
(74) *Attorney, Agent, or Firm* — Gottlieb, Rackman & Reisman, P.C.

(57) ABSTRACT

Apparatus for heating fluids through rotary magnetic induction, which has at least one rotating central disc of magnets and at least one bilateral heat exchanger, wherein the magnet disc comprises at least one pair of magnets disposed in such disc and whose configuration exposes the magnets to both sides of the disc with alternating polarity on each side to generate on both sides an agitated magnetic field, and wherein at least one heat exchanger, comprising at least one low resistivity metal surface, is disposed adjacent to each side or face of the magnet disc in order to expose its metal surface to the agitated magnetic field, getting heated and transmitting such heat to a fluid circulating within at least one configured conduit located inside the heat exchanger.

16 Claims, 9 Drawing Sheets

(56) References Cited

U.S. PATENT DOCUMENTS

| | | | | | |
|---|---|---|---|---|---|
| 5,994,681 | A * | 11/1999 | Lloyd | F03G 6/04 | 219/631 |
| 6,290,882 | B1 * | 9/2001 | Maus | B29C 45/561 | 264/2.2 |
| 7,339,144 | B2 * | 3/2008 | Lunneborg | H05B 6/108 | 219/631 |
| 7,420,144 | B2 * | 9/2008 | Lunneborg | H02K 49/108 | 219/628 |
| 9,883,552 | B2 * | 1/2018 | Nangle | H05B 6/108 | |
| 2005/0263522 | A1 * | 12/2005 | Lunneborg | H05B 6/108 | 219/672 |
| 2006/0086729 | A1 * | 4/2006 | Lunneborg | H02K 49/108 | 219/628 |
| 2013/0092681 | A1 * | 4/2013 | Nangle | H05B 6/108 | 219/630 |

* cited by examiner

APPARATUS FOR HEATING FLUIDS BY ROTARY MAGNETIC INDUCTION

CROSS-REFERENCE TO RELATED APPLICATION

This application is the U.S. National Phase of International Patent Application No. PCT/CL2015/050023, filed Jul. 3, 2015, the contents of which is herein incorporated by reference in its entirety.

FIELD OF INVENTION

The present invention refers to an apparatus for heating fluids by magnetic induction, more specifically, it corresponds to a bilateral magnetic induction heat generator unit for heating fluids flowing through at least one multiple heat exchanger.

INVENTION BACKGROUND

Heat may be generated in an electrically conductive material submitting it to a magnetic field subject to movement. The movement of the magnetic field generates eddy currents, corresponding to Foucault's circular currents, where by placing a conductive material near to this field, a flow of electrons is generated on the induced conductive material, opposed to the effect of the magnetic field, thus generating heat. This heat may be harnessed by putting a fluid in contact with the heated metallic material, thus transferring the heat from the metallic piece to the fluid, this way increasing its temperature to the desired range. The variables that influence the amount of heat generated in such conductive material are: the strength of the magnetic field, the number of magnets, the relative space between them, the conductive material and the rotation velocity of the magnets. Others factors that affect the amount of heat generated are the resistivity, permeability, size and shape of the heated body, and the size and shape of the magnets.

An apparatus and method for heating a fluid by induction heating is described in the U.S. Pat. No. 5,914,065 (Kamal Alavi) document, where such apparatus comprises a non-magnetic heating element with opposing sides, a rotating piece supported by a shaft and disposed adjacent to the first side of the heating element, where the rotating piece has at least one pair of permanent magnets that generates eddy currents in the heating element when a relative movement is produced between the rotating piece and the heating element by the rotation of the shaft. A second rotating piece supported by the shaft and disposed adjacent to the second opposing side of the heating element, also having at least one pair of permanent magnets and also generating eddy currents in the heating element when a relative movement is produced between the second rotating piece and the heating element by rotation of the shaft. This setting for heating fluids, using two parallel discs facing each other, makes the operation somewhat risky, since the forces exerted on both discs are confronted which can lead to the detachment of magnets, thus requiring extra efforts to hold them secure in the disc. In addition, doubling the discs and magnets for the heating apparatus means higher costs of manufacture and higher energy consumption when functioning, without necessarily increasing the heating capacity of the fluid in comparison with alternative simpler settings.

A magnetic furnace for generation of heat used in central heating system to heat spaces is described in the WO 2014/137232 (Bil Robert) document, which comprises a water tank, discs arranged at the wall of the tank, at least one motor for rotating the discs and a frame on which everything is mounted. A source of magnetic field is arranged in the circumference of the disc, so that the rotating discs generate a magnetic field closed enough to the wall of the tank which is made from non-magnetic material, such as aluminum and its alloys, and copper and its alloys. This way, it is possible to heat the wall of the tank due to eddy currents generated by the rotating discs with the magnets.

However, just as the last invention described, the designs are complex, inevitably affecting their production and operation costs.

The problems that the prior art documents attempt to solve are related to efficiency, production costs and expected results of the efficient fluid heating, so that they can present a real alternative in comparison with traditional heating systems.

This way it is necessary to provide an apparatus for heating fluids that presents a much simpler configuration with a less expensive operation and more efficient. A magnetic induction fluid heating apparatus that is nonpolluting and suitable for domestic and industrial fluids heating processes.

BRIEF DESCRIPTION OF THE INVENTION

The main objective of this invention is to provide an apparatus for heating fluids through magnetic induction with such a configuration that allows achieving a much more efficient heat transfer to the fluid with the same energy consumption.

The second objective of this invention is to provide such an apparatus that is cost effective, with a simple design, easy to use, efficient and non-polluting, in such way that it becomes a real alternative for domestic and industrial use.

An additional objective of this invention is to provide an apparatus configure in such way that it is possible to use it on a domestic or industrial scale.

The present invention provides an apparatus for heating fluids by rotary magnetic induction, which has at least one rotary central disc of magnets and at least one bilateral heat exchanger, wherein the magnet disc comprises at least one pair of magnets disposed in the disc and whose configuration exposes the magnets to both sides of the disc with alternating polarity on each side to generate on both sides an agitated magnetic field, and wherein the one or many heat exchangers, comprising at least one low resistivity metal surface, is disposed adjacent to each side or face of the magnet disc in order to expose its surface to the agitated magnetic field, getting heated and transmitting such heat to a fluid circulating within at least one configured conduit located within the heat exchanger.

BRIEF DESCRIPTION OF THE FIGURES

With the aim of helping a better comprehension of the invention features, a preferred example of setting is given. As part of the example description a set of illustration is attached to this document, representing the invention.

DETAILED DESCRIPTION OF THE INVENTION

Figure 1:
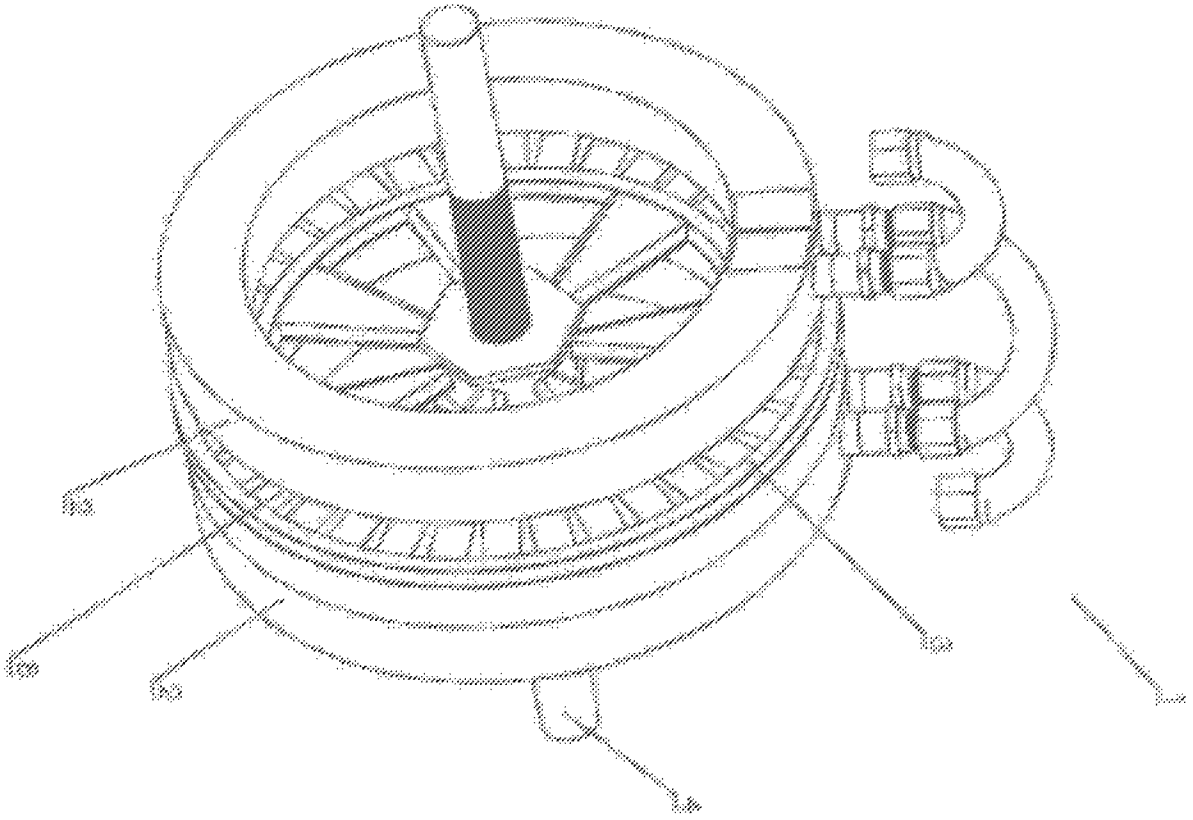
FIG. 1 corresponds to a side view in 3D of the invention's apparatus for heating fluids.
Figure 4:
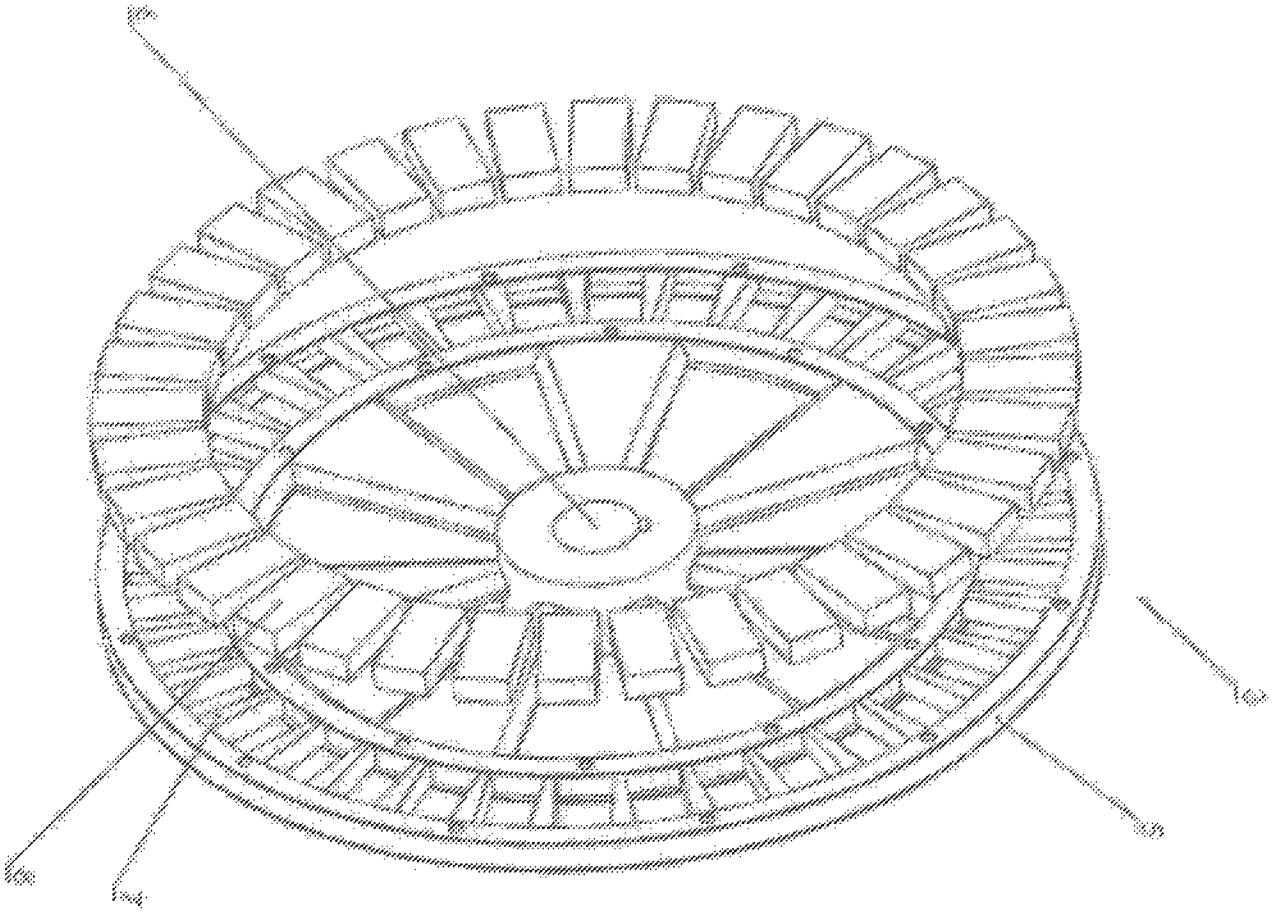
FIG. 4 corresponds to a side view in 3D and the exploded view of the magnetic field generating disc of the invention's apparatus for heating fluids.

An apparatus for heating fluids (1) by magnetic induction, illustrated in FIG. 1, comprises at least one heat exchanger (2), a magnets holding disc (3) disposed in a centered position, surrounded by two adjacent heat exchangers connected to each other and separated apart at an adjustable distance from the magnets holding disc to the surface or side face of the heat exchanger (2). The magnets holding disc is mounted on a central shaft (4). As seen in detail in FIG. 4, the magnets holding disc (3) comprises a main body (5) that has a central opening (6) where the shaft comes through (4) and allows it to rotate. The main body has a series of cavities (7) disposed radially in the circumference of the disc that has the same shape of the magnets, in such way that is possible to hold them tightly. The magnets correspond to high frequency neodymium, which are placed in such cavities (7) in a radial fashion along the circumference of the holding disc, alternating their polarities in such a way that there is always a positive source next to a negative source. The magnets are fixed to the disc so that the two main faces of the magnets (8) are exposed on both sides of the holding disc, enabling the free exposure of two magnetic fields, i.e., a magnetic field in each main face of the magnets holding disc (3).

At least one heat exchanger (2) is displaced adjacent to each side of the magnets holding disc (3) in such a fashion that the heat exchanger (2) is exposed to the magnetic fields of each side of the holding disc (3).

When alternating the polarity of the magnets (8) in the magnets holding disc (3) and rotating the disc at high speeds, an agitated magnetic field is created, generating an electric phenomenon known as Foucault currents or eddy currents, that disorganize the molecular structure of a conductive metal surface that enters in contact with it. As a result this conductive metallic surface will heat, due to atoms excitement.

Figure 2:
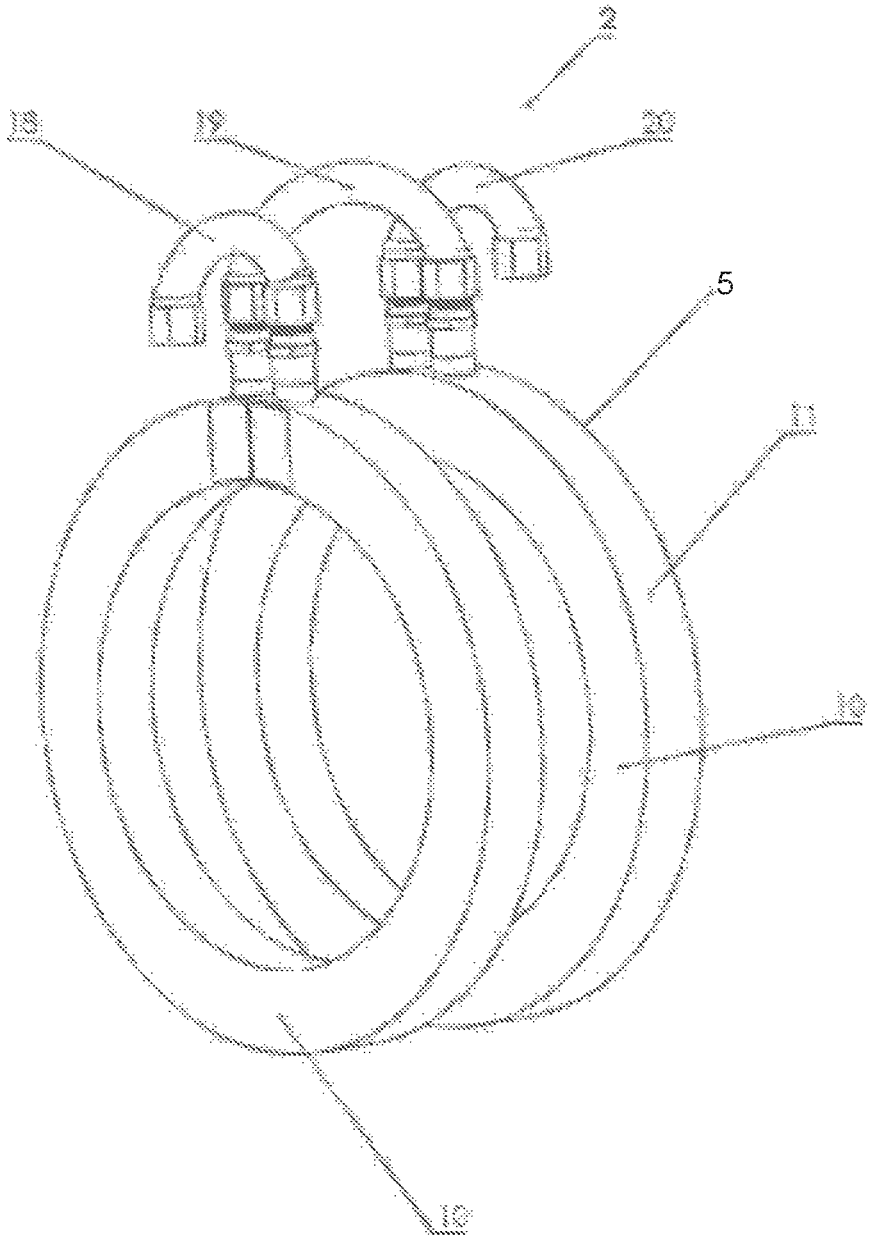
FIG. 2 corresponds to a side view in 3D of the heat exchanger device of the invention's apparatus for heating fluids.
Figure 6:
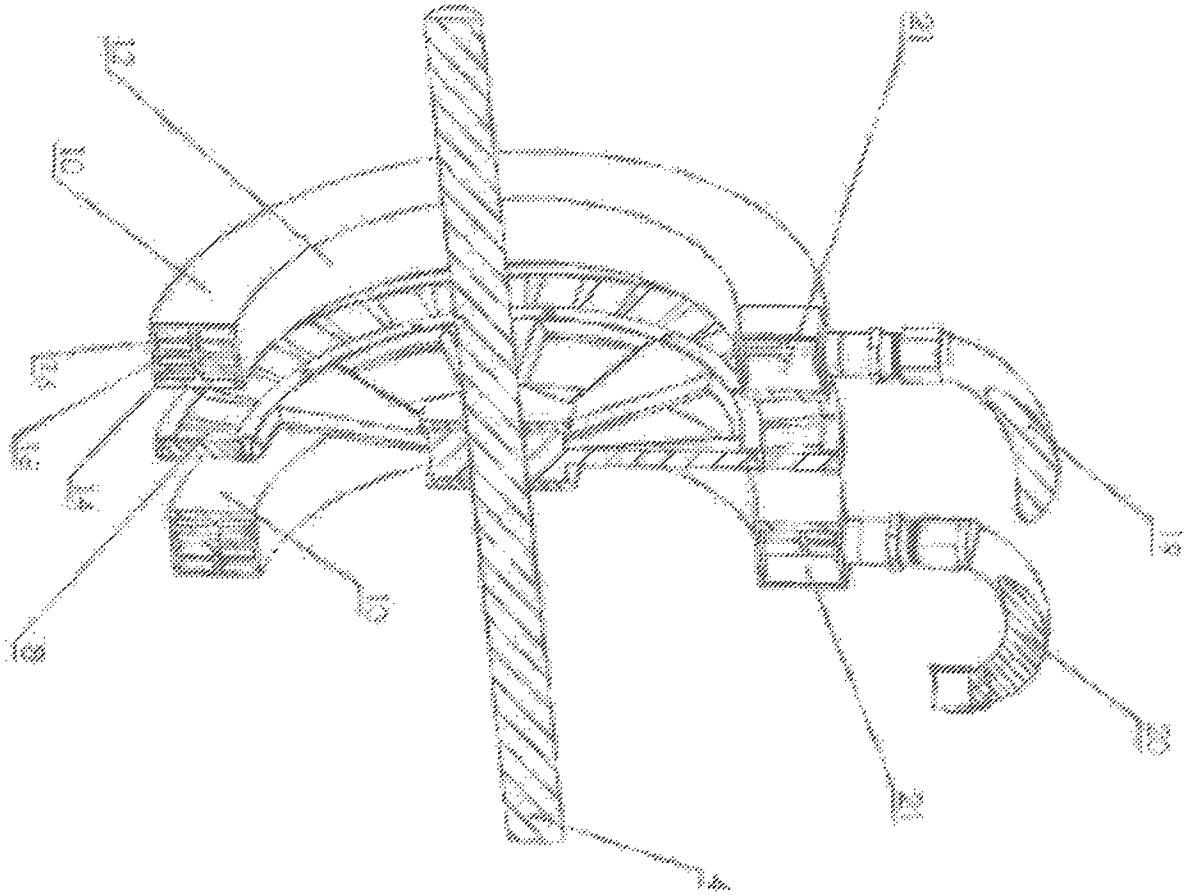
FIG. 6 corresponds to a 3D side view of the cross section of the invention's apparatus for heating fluids.
Figure 7:
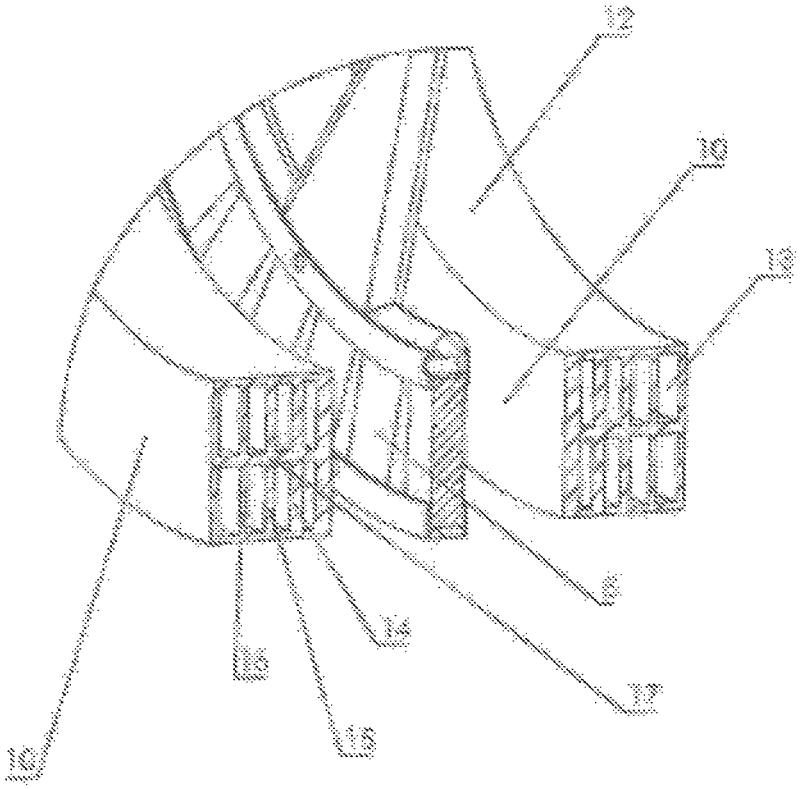
FIG. 7 corresponds to an expanded view of the cross section of a 3D side view of a section that shows partially the heat exchanger and the magnets holding disc of the invention's apparatus for heating fluids.
Figure 8:
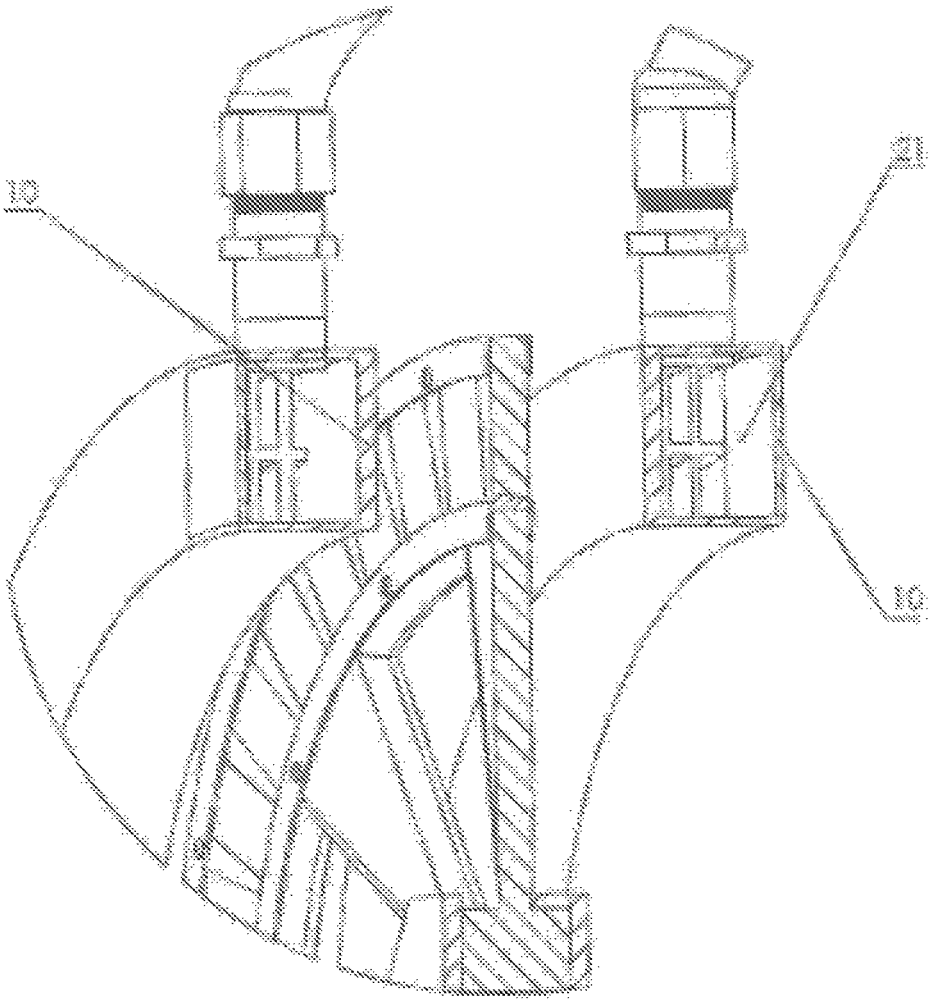
FIG. 8 corresponds to an expanded view of the cross section of a 3D side view of a section that shows the inlet and outlet ports of fluid of the heat exchanger of the invention's apparatus for heating fluids.

FIGS. 2, 6 and 7 shows in detail the configuration of each heat exchanger (2), which comprise a ring-shaped main body (5) in which interior runs a fluid. It has flat interior and exterior side walls (10). The outer wall is convex (11) and the inner is concave (12), thus forming an interior conduit through which a fluid runs.

This conduit can comprise a number of inner ducts (13), just as it is shown in detail in FIG. 7, where each of this inner ducts is formed by longitudinal plates (14, 15, 16) and one transversal plate (17), resulting in a reticulated inner ducts (13). The thickness of each plate forming the ducts is different.

The thickness of the longitudinal plates (14, 15, 16) including the side walls (10) varies in the direction of the agitated magnetic field. This is, the more close to the disc, where the intensity of the magnetic field is the highest, the thicker will be the longitudinal plate, so that the interior side wall (10) is the thickest. As an example, if the interior side wall would have a thickness of 5 mm, then the inner longitudinal plates (14, 15, 16) would have 4, 3 and 2 mm respectively, and the exterior side wall (10) would have 1 mm. This way, the thickness of the interior side wall, that is closest to the magnet disc (3) is higher because this acts exponentially on the results of the heat transferred to the fluid, maximizing the effect in the proximity, where the intensity of the magnetic field is higher.

The heat exchanger should be made from a low electric resistivity material. As an example, a low electric resistivity material is copper, often used for heat exchangers (2) fabrication.

Figure 3:
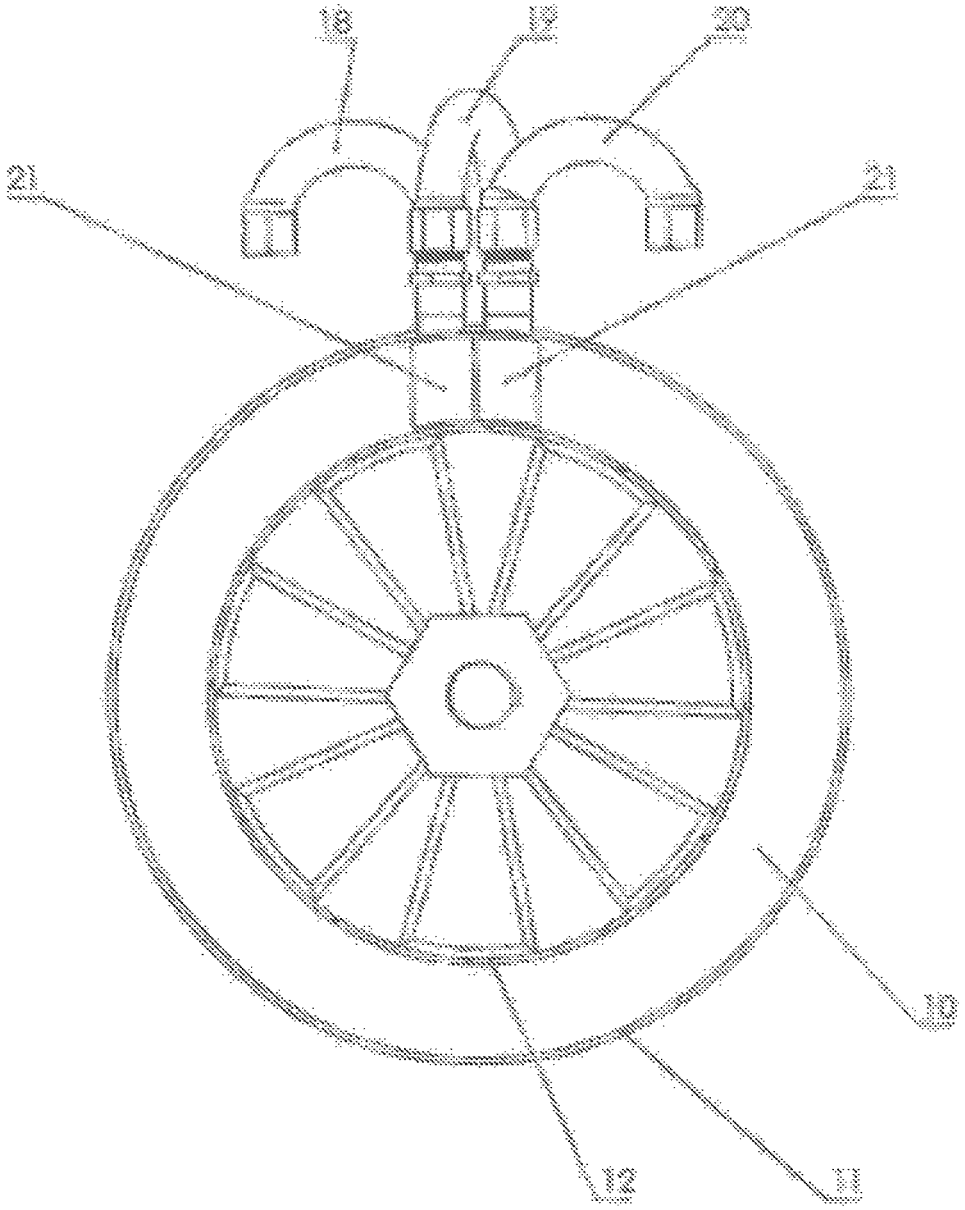
FIG. 3 corresponds to a side view of the invention's apparatus for heating fluids.
Figure 5:
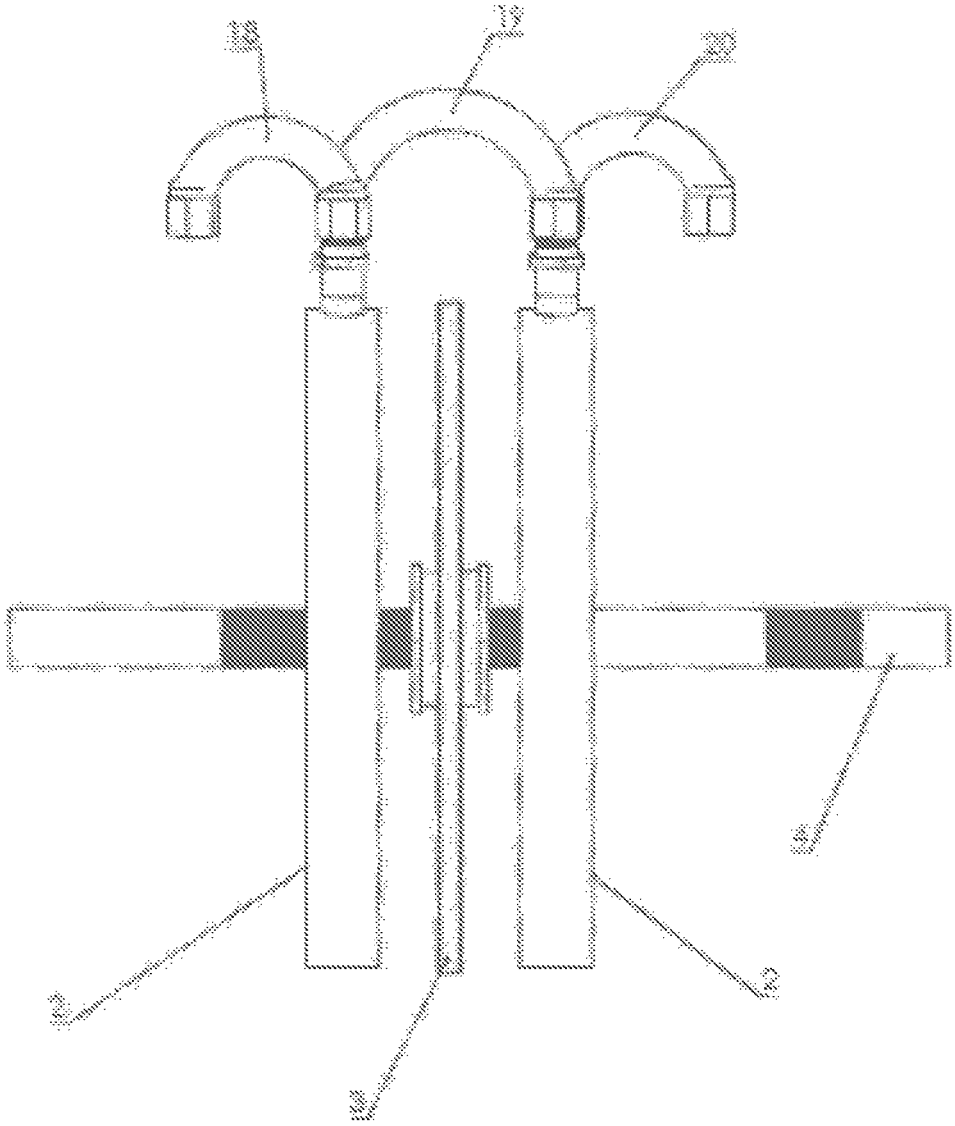
FIG. 5 corresponds to a front view of the invention's apparatus for heating fluids.

At the top of the main body of the heat exchanger (2) (FIGS. 2, 3 and 5), is placed an inlet (18), an outlet (20) and a flexible tube (19) that connects both bilateral heat exchangers. The inlet and outlet of fluid comprise an entrance and exit ports (21) from the heat exchanger, formed by a cavity without internal plates (see FIG. 6).

Figure 9:
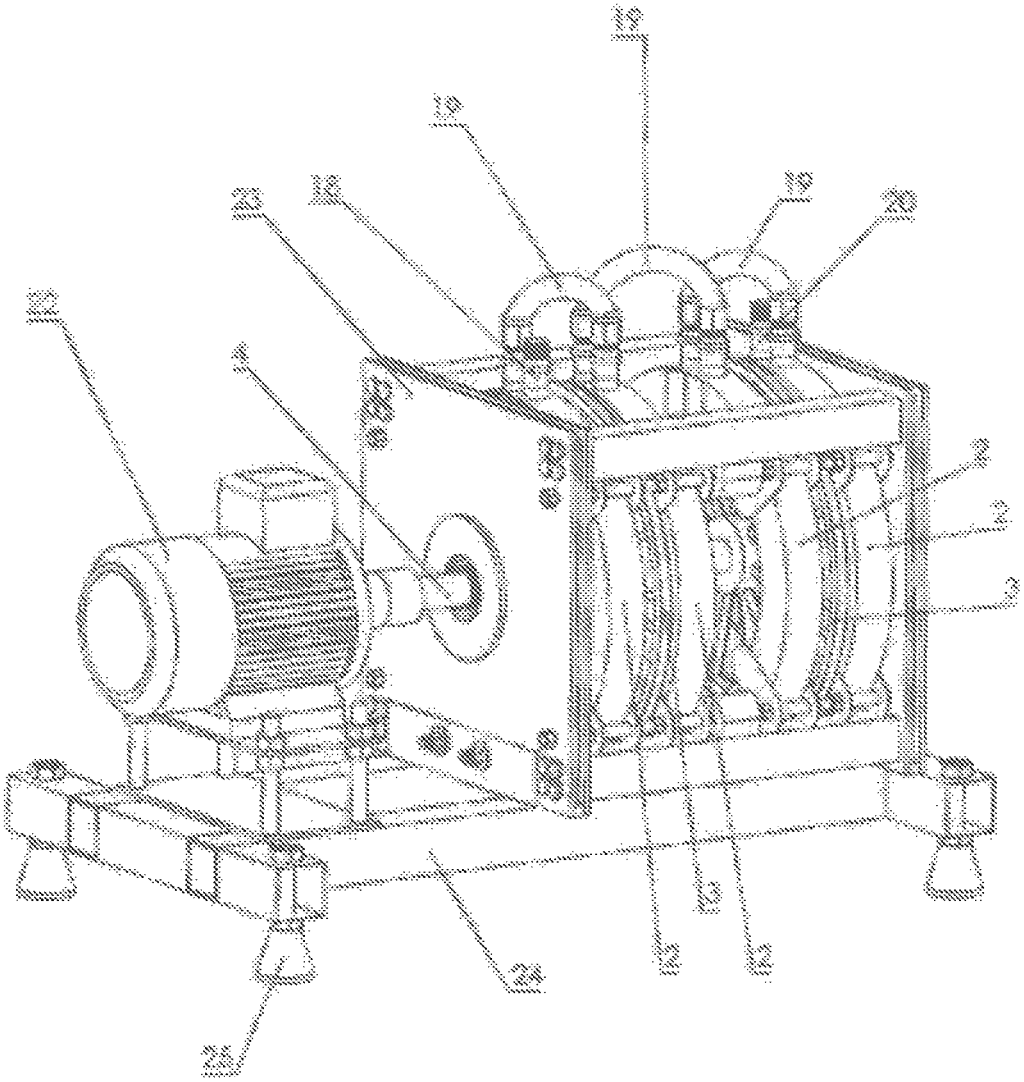
FIG. 9 is a 3D side view of a fluid heating apparatus that comprises at least one apparatus for heating fluids of the invention's apparatus for heating fluids.

The flexible tube (19) of the outlet is designed so that it can be connected to an inlet of a different heat exchanger, this way being possible to connect in series several heat exchangers. This setting allows to assemble an apparatus for heating fluids that comprises several heat exchanger, thus forming part of an apparatus for heating fluids (1) interconnected to each other forming an apparatus for heating fluids, just as shown in FIG. 9, where as an example such apparatus is formed by two units of fluid heating apparatus. This setting allows for considerably reduced time that is required for heating a fluid, doing the process more efficiently.

An alternative of the invention is to connect the heat exchanger to a source of fluid, like some kind of collector, such as domestic or industrial hot water tanks.

In the preferred application of the invention, illustrated in FIGS. 1, 4, 5 and 6, the apparatus is form by a magnets holding disc (3) with several magnets (8) disposed in cavities (7) in such a way that the magnets become exposed to both sides of the disc. Next to each side of the magnets holding disc (3) is placed a heat exchanger unit (2) in such way that the two interior flat walls (10) of the heat exchangers are exposed at a determined close distance to the disc's magnets. The heat exchangers are connected to each other by a flexible tube (19), allowing fluid to flow from a heat exchanger unit to another, keeping the flow. A central shaft (4) rotates the magnets holding disc (3) generating eddy currents that enters in contact with the conductive surface of the heat exchanger. First the interior side wall (10) and then the inner longitudinal plates (14, 15, 16), disarranging the molecular structure of the plates thus heating them and transmitting the heat to the fluid, inside the ducts (13). This setting allows the rotating disc to propagate eddy currents from both sides of the disc, this way heating the metal surface of the nearest exposed face of the heat exchanger placed next to the disc. This way maximizing the capture of such energy and turning it into heat.

The amount of heat (P) that can be passed to the fluid inside the heat exchangers (2), (i.e., calorific value) will depend on a variety of factors such as the resistivity of the heat exchanger's material, the frequency at which the disc operates measured in Hertz, magnetic flux density measured in Gauss, and the thickness of the heat exchanger's metal plates which affects the degree to which the magnetic field penetrates the metal. All this factors are defined by the calorific value formula. Also, these factors will determine the ultimate design and position of heat exchangers.

Calorific Value Formula $$P=K*f^2*B^2*s^2$$

Where:

P=Calorific value

K=Constant inversely proportional to specific electric resistivity of the utilized metal.

F=Frequency measure in Hertz equivalent to the cycles per second of rotation multiplied by the number of pairs of magnets with different polarity.

B=Density of the magnetic flux measured in Gauss.

S=Thickness of the contacting surface of the magnetic field inducted metal.

The heat exchanger that intercepts the magnetic field should be made of a low resistivity metal, such as silver, copper, gold and aluminum (increasing order). This way the heat exchanger can be made of any of these materials, copper being the most preferred because of its low resistivity and low relative cost.

The frequency, in cycles per second, of a number of pairs of magnets with different polarities affects the heating, exponentially. This way, the higher the frequency, the higher the heating. Also, the strength of each magnet will exponentially affect the heating of the metal. The distance between the metal surface and the magnets will also directly affect the heating performance, reaching an optimal in a place very close to the force field, where the electrons excitement is higher and more eddy currents are produced.

The thickness of the metal intercepted by the magnetic field acts exponentially on the transference of heat to the circulating fluid inside the heat exchanger. For this reason, both faces closest to the magnetic field source (i.e., the magnets holding disc) has been set so that they are the thickest. And so is contemplated a series of inner cavities inside the heat exchanger, formed by a series of cross sectional and longitudinal plates that allows increasing volume of the induced metal and slowing down the fluid circulation, resulting in a greater transference surface area and a longer contact time of the circulating fluid inside the heat exchanger (see FIGS. 6 and 7).

An example of application for this invention, just as it is illustrated in FIG. 9, comprises at least one apparatus for heating fluids by magnetic induction (1), a frame (24), support and positioning frame legs (25), a support and mounting structure (23) for at least one apparatus for heating fluids (1) and one engine (22). In the particular setting shown in FIG. 9, two magnetic induction apparatus for heating fluids (1) have been arranged one next to the other and connected to each other through an additional flexible tube. However, depending on the amount of water required to heat and the desired temperature, any number of fluid heating devices can be set and connected to each other forming a single machine.

When functioning, the engine (22) rotates the shaft (4) which is connected to an apparatus for heating fluids (1) of the apparatus with its own disc of magnets (3) where all is supported and restrain by a support and mounting structure (23). The engine (22), the shaft (4) and the fluid heating apparatus mounting are supported by a frame (24) that comprises support and positioning legs (25) that allows adjustment and leveling of the apparatus. The heat exchangers (2) of each apparatus for heating fluids (1) are connected to a source of fluid supply through an inlet (18) and outlet (20) port and connected to each other through flexible tubes (19). The fact that the heat exchangers (2) are interconnected through flexible tubes, allows for ease adjustment of the distance between the magnets holding disc (3) and the heat exchangers (2), as needed. The heat exchangers can be brought together to the discs through a distancing regulation mechanism such as endless screws or other similar mechanism that can both support the heat exchangers and adjust the distance between the inner surface of the heat exchanger and the magnetic field generated by the rotating magnets holding disc. The rotation mechanism of the magnets holding discs makes them spin at high revolution per minute generating frequencies measured in hertz that can be adjusted to spin from a few revolutions per minute for a domestic use apparatus, to a high revolutions per minute for an industrial use apparatus. In other words, it is an apparatus capable of working at variable frequencies, even more if it is possible to vary the number of pairs of magnets in each disc (3) which can exponentially affect the caloric power of the fluid heating apparatus.

It is possible to increase the heating capability of a single unit of a bilateral magnetic induction heat generation apparatus by modifying its components, such as the number of magnets pairs of the disc, the strength of magnets, the thickness of the heat exchanger and the resistivity of the metals, and also by increasing the frequency of disc rotation.

The heat exchangers, by being connected through flexible tubes allows the free circulation of the fluid between them thus generating a continuous loop where the fluid gets progressively warmer as it flows through the inner cavities of the heat exchangers and gets in contact with the cross sectional, transversal and superficial plates surfaces. A set of temperature control mechanisms; direct reading thermometers, thermostats, among others; are placed in the apparatus so that it is possible to set and control the temperature of the fluid inside the heat exchangers.

The configuration of the apparatus for heating fluids by magnetic induction (1) of this invention allows for heating fluids with low production cost and in a simple and efficient manner since the magnets are exposed to both sides of the disc, generating two adjacent magnetic fields thus exploiting full capacity of the magnets and saving production costs because of its simpler design resulting in a much smaller and lighter apparatus, where the configuration of each heat exchanger has maximized the heat conductive surface for the fluid. Also, the fact that it is possible to adjust the distance between the heat exchangers and the magnetic field generated even when functioning, achieving high efficiency in the heating of the circulating fluid, marks a significant difference with the magnetic fluid heaters of the prior art, where a magnets holding disc exposes the magnets in a single side, thus requiring a set of two magnets holding discs facing each side of a heat exchanger and also where the heat exchanger presents a single cavity through which the heating fluid circulates.

The configuration of the apparatus for heating fluid by magnetic induction of the invention achieves a much more efficient result in the transfer of heat to the fluid for the same power consumption than the prior art devices, therefore this invention provides an apparatus that allows to heat fluids at a low cost, thus being a great alternative for heating fluids for domestic use, such as central heating and sanitary hot water, and industrial use, being also a non-polluting source for heating fluids.

Although the configuration of the apparatus here described is a preferred choice for this invention, it must be understood that the invention it is not limited to it and it is possible to make changes without hindering the objective of the invention defined in the claims attached.

The invention claimed is:

1. An apparatus for heating fluids by magnetic induction comprising:

a pair of interconnected heat exchanger elements configured generally parallel to one another, each formed as a generally closed ring with an internal hollow area, each having an inlet and an outlet configured for internal fluid flow, and each comprising a high electrically and thermally conductive metal surface, wherein the outlet of one of said pair is connected to the inlet of the other of said pair by external flexible tubing;

a rotatable disc for holding a plurality of magnets, wherein said disc is disposed generally parallel to, adjacent to, and between said heat exchanger elements, said disc generally shaped as a circular ring with a first face and an opposing face, said disc comprising a plurality of cavities, each said cavity configured to hold a magnet, said disc including a central hub located in the center of a diameter;

a plurality of magnets disposed in said rotatable disc, said plurality of magnets disposed with alternating polarity in said plurality of cavities, up to one magnet in each cavity, each said magnet disposed to be exposed to both of said first and said opposing faces; and a frame for holding said heat exchanger elements and said rotatable disc, wherein said frame is configured to allow for adjusting the distance between at least one of said heat exchanger elements or a heat exchanger element and a face of said disc.

2. The apparatus for heating fluids by magnetic induction of claim 1 further comprising a rotatable central shaft for said disc configured to attach to an engine, said shaft configured to pass through said central hub of said disc and pass through a location of a center of a diameter of at least one of said heat exchanger elements.

3. The apparatus for heating fluids by magnetic induction of claim 1, wherein each said cavity extends from said first face of the disc to said opposing face.

4. The apparatus for heating fluids by magnetic induction of claim 1, wherein each said heat exchanger element's hollow area includes a plurality of inner ducts for fluid, said ducts separated from one another by a series of plates with varying thickness.

5. The apparatus for heating fluids by magnetic induction of claim 4, wherein said thickness increases with the increased distance the plate is from a heat exchanger.

6. The apparatus for heating fluids by magnetic induction of claim 4, wherein said plates align longitudinally.

7. The apparatus for heating fluids by magnetic induction of claim 1, wherein each said cavity is in the peripheral portion of said disc and is in the shape of a magnet.

8. The apparatus for heating fluids by magnetic induction of claim 1, wherein said magnets comprise neodymium.

9. The apparatus for heating fluids by magnetic induction of claim 1, wherein each said heat exchanger element is comprised of at least one of silver, copper, gold and aluminum.

10. A method for heating a fluid using a heat exchanger apparatus comprising the steps of:

arranging a configuration including a pair of heat exchanger elements and a rotatable disc connected to an engine-driven common shaft; and flowing a fluid through a pair of heat exchanger elements situated on either side of a rotatable disc holding a plurality of magnets; wherein:

each heat exchanger element in said pair of heat exchanger elements is configured to essentially be parallel to the other, each is formed as a generally closed ring with an internal hollow area, and each comprising a high electrically and thermally conductive metal surface, each resting in a frame and laterally adjustable in said frame, each having an inlet and an outlet configured for internal fluid flow, wherein the outlet of one of said pair is connected to the inlet of the other of said pair by external flexible tubing;

said disc is disposed adjacent to and between said heat exchanger elements and generally shaped as a circular ring with a first face and an opposing face, said disc comprising a plurality of cavities, with each said cavity configured to hold a magnet; and said plurality of magnets is disposed with alternating polarity in said plurality of cavities, up to one magnet in each cavity, each said magnet disposed so as to be exposed to each of said first and opposing faces.

11. The method for heating a fluid of claim 10, wherein each said cavity extends from said first face of the disc to said opposing face.

12. The method for heating a fluid of claim 10, wherein each said heat exchanger element's hollow area includes a plurality of inner ducts for fluid, said ducts separated one from another by a series of plates with varying thickness.

13. The method for heating a fluid of claim 12, wherein said thickness increases as the plate becomes closer to a magnetic field.

14. The method for heating a fluid of claim 12, wherein said plates align longitudinally.

15. The method for heating a fluid of claim 10, wherein said magnets comprises neodymium.

16. The method for heating a fluid of claim 10, wherein said heat exchanger element is comprised of at least one of silver, copper, gold and aluminum.

* * * * *